US005293718A

United States Patent [19]

Favaron

[11] Patent Number: 5,293,718

[45] Date of Patent: Mar. 15, 1994

[54] TANGENTIAL GRINDING MACHINE PARTICULARLY FOR RAILWAY RAILS

[75] Inventor: Claudio Favaron, Venezia Mestre, Italy

[73] Assignee: Loram Maintenance of Way, Inc., Hamel, Minn.

[21] Appl. No.: 949,231

[22] PCT Filed: May 3, 1991

[86] PCT No.: PCT/EP91/00841

§ 371 Date: Jan. 6, 1993

§ 102(e) Date: Jan. 6, 1993

[87] PCT Pub. No.: WO91/17310

PCT Pub. Date: Nov. 14, 1991

[30] Foreign Application Priority Data

May 8, 1990 [IT] Italy ..... 84127 A/90

[51] Int. Cl.[5] ..... B24B 49/00

[52] U.S. Cl. ..... 51/165.87; 51/178

[58] Field of Search ..... 51/96, 97, 33 R, 165 R, 51/165.71, 165.74, 165.75, 165.76, 165.77, 165.82, 165.87, 178

[56] References Cited

U.S. PATENT DOCUMENTS

| | | | |
|---|---|---|---|
| 4,115,857 | 9/1978 | Paneffi | 51/178 |
| 4,189,873 | 2/1980 | Paneffi | 51/178 |
| 5,044,126 | 9/1991 | Baldo | 51/178 |
| 5,086,591 | 2/1992 | Paneffi | 51/165.71 |
| 5,134,808 | 8/1992 | Paneffi | 51/165.71 |

*Primary Examiner*—M. Rachuba

*Attorney, Agent, or Firm*—Patterson & Keough

[57] ABSTRACT

A tangential grinding machine for railway rails has a rotating member, a plurality of abrasive sectors mounted on supports radially movable on the rotating member, elements which radially move the supports in order to move the abrasive sectors outwards by an extend which compensates their wear, and a plurality of sensors which when a predetermined degree of wear of the abrasive sectors is attained are activated to act under the control of an electronic unit on the radially movable supports, in order to restore the original grinding surface of the abrasive sectors which have undergone wear. In between the rotating member and the machine structure slidable on the rail there is interposed an articulated frame provided with a mechanism to cause the rotating member to undergo transverse oscillations about a longitudinal axis substantially coinciding with the axis of curvature of the corresponding band of the rail to be ground.

18 Claims, 3 Drawing Sheets

TANGENTIAL GRINDING MACHINE PARTICULARLY FOR RAILWAY RAILS

This invention relates to a tangential grinding machine, particularly for railway rails.

EP-A2-O 318 521 describes a tangential grinding machine comprising a rotating member, a plurality of abrasive sectors supported by supports radially movable on said rotating member, elements which radially move said supports in order to move said abrasive sectors outwards by an extend which compensates their wear, and a plurality of sensors which when a predetermined degree of wear is attained are activated to act under the control of an electronic unit on the radially movable supports, in order to restore the original grinding surface of the abrasive sectors which have undergone wear.

Because during working the grinding wheels wear in accordance with the deformation of the rail profile to be ground, and hence in a non-uniform manner, a grinding manner consisting essentially of a diamond-set tool is provided which, during the working of the machine, automatically recreates the profile of the abrasive sectors which is altering due to their wear.

This known grinding machine has proved effective in that it combines the merits of high operability and precise results with the merits of considerable compactness and a high degree of safety. In particular, it has been advantageously used in the case of tramway rails in which the limited vehicle speed, the weights and the stresses concerned are such as not to produce large deformation of the rail profiles. However in the case of railway rails the requirements are of a different kind, both because of the extent of the rail profile deformations and because of the nature of the deformations, which involve the formation on the top of the inner side of the rail of a substantially pronounced longitudinal projection, resulting in rapid and non-uniform wear of the abrasive sectors and a likewise rapid wear of the diamond-set tool used to restore their original profile.

GB-A- 2 110 966 disclosed a rotary grinder having a tool which rotates about an axis extending radially and essentially passing through the center of curvature of the band of the rail to be ground.

An aim of the invention is to realize a grinding machine which enables the profile of railway rail to be totally and perfectly ground however deformed.

A further aim of the invention is to realize a grinding machine which maintains a constant abrasive sector profile and restores it in a virtually perfect manner.

These and further aims are achieved according to the invention through a tangential grinding machine as described in claim 1.

The present invention is further clarified hereinafter with reference to the accompanying drawings, in which.

Figure 1:
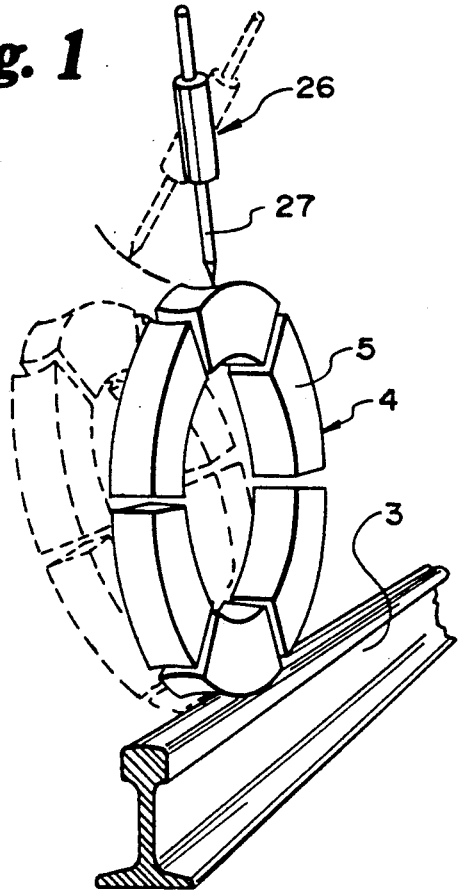
FIG. 1 is a schematic perspective view showing the priciple on which the grinding machine of the invention is based.
Figure 2:
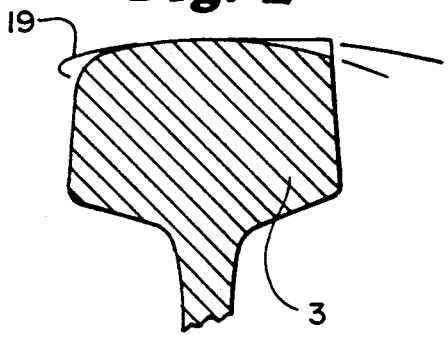
FIG. 2 is a cross-section through a rail portion to an enlarged scale.
Figure 3:
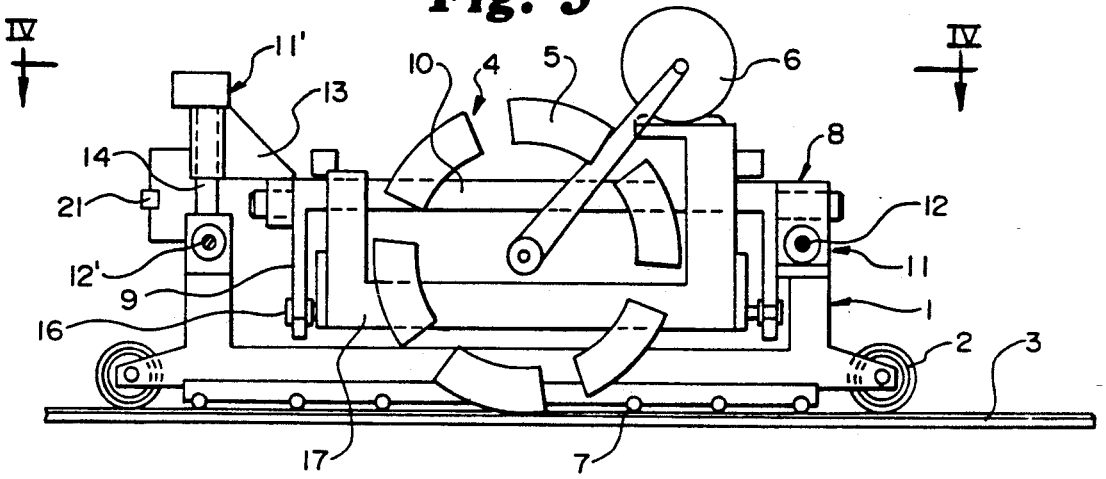
FIG. 3 is a schematic side view of the grinding machine according to the invention.
Figure 4:
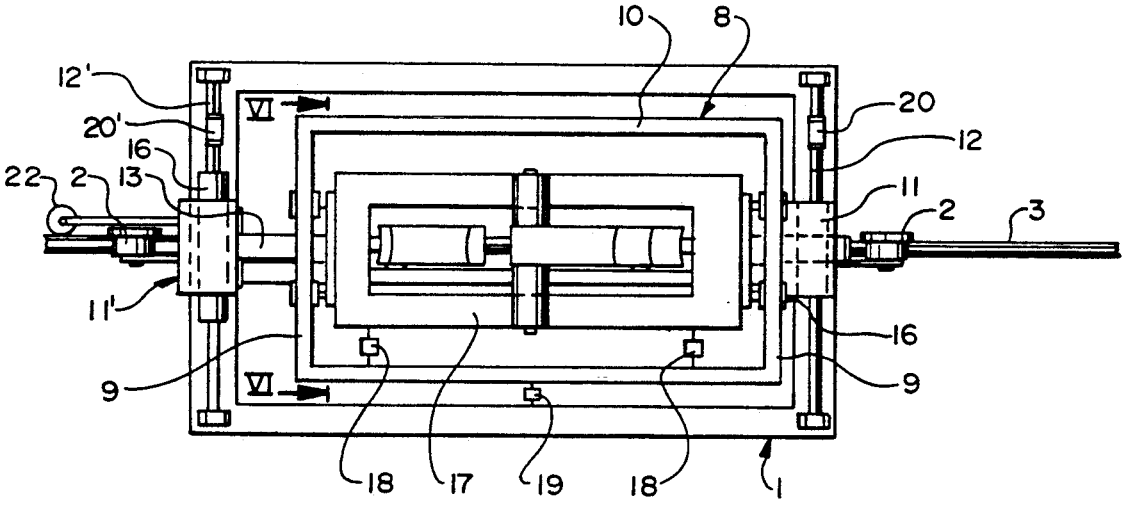
FIG. 4 is a plane view thereof on the line IV—IV of FIG. 3.
Figure 5:
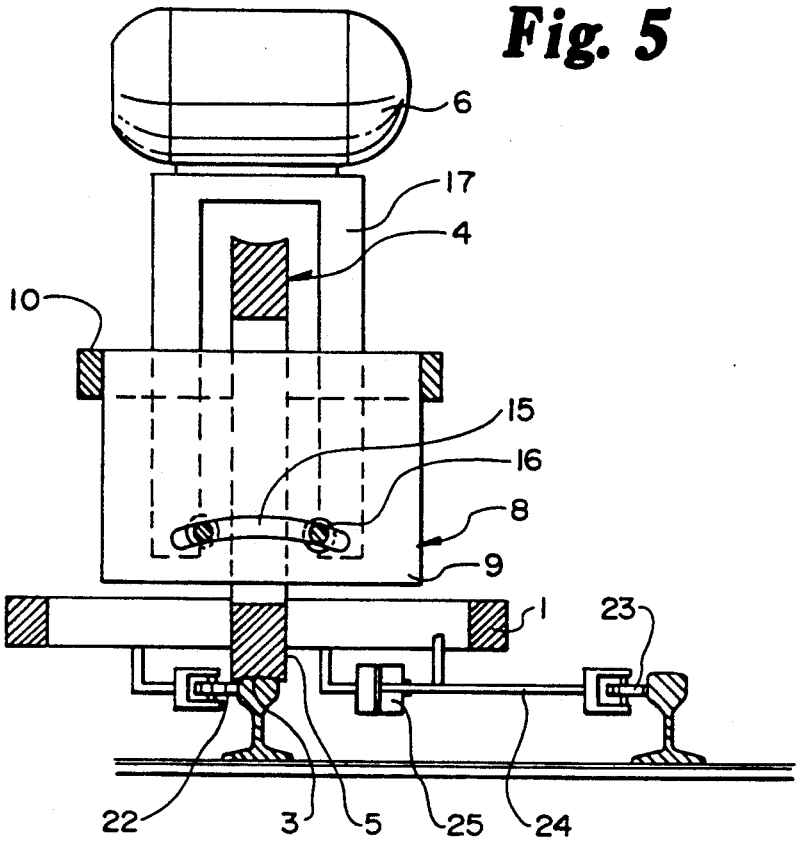
FIG. 5 is a cross-section therethrough.
Figure 6:
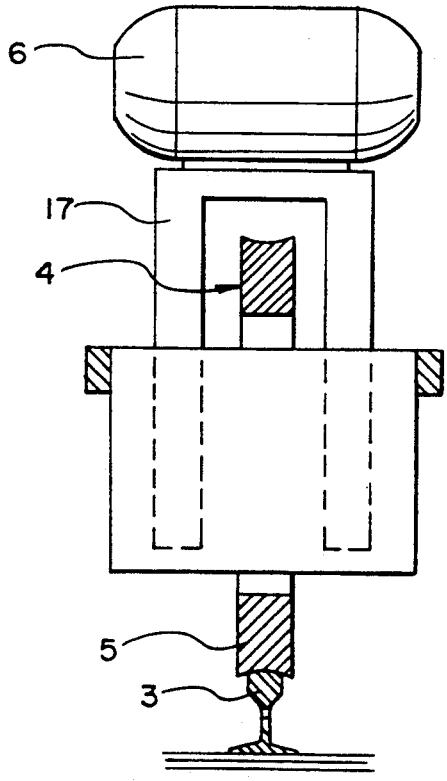
FIG. 6 is a cross-section on the line VI—VI of FIG. 4.

As can be seen from the figures, the machine according to the invention comprises a structure 1 provided with wheels which run on the rail 3 to be ground. The tangential grinding device, indicated overall by 4, is of the type described in the cited EP-A2-O 318 521, none of the constructional details given in this latter having however been included in the present description, for reasons of clarity. It need merely be stated that this grinding device is provided with a plurality of abrasive sectors 5 rotated simultaneously by an electric motor 6 and mounted on supports (now shown) which are movable radially outwards to ensure that the circumferential grinding surface remains rigorously constant as the wear to which said sectors 5 are subjected during working varies. The outward movement of these supports and the relative abrasive sectors 5 is controlled by a plurality of sensors (now shown) which are normally "covered" by the sectors when they operate on the rail to be ground, but are uncovered when the sectors 5 wear beyond the predetermined amount.

In addition to the wheels 2, the structure 1 is also provided lowerly with a plurality of rollers 7 which overall form a roller table for supporting and guiding the entire machine on the rail 3 to be ground, to overcome the inevitable longitudinal undulations by virtue of this distributed support, or at last to attenuate their effect.

The structure 1 supports an intermediate frame, indicated overall by 8 and comprising two shoulders 9 joined by two longitudinal members 10. The entire assembly is supported at its ends by two tubular supports 11, 11' slidable along transverse guides 12, 12' provided in the structure 1. More specifically, one of the two tubular supports 11 is hinged to the corresponding guide 12 about the axis of this latter, whereas the other tubular support 11' consists in reality of a portion 13 rigid with the frame 8 and slidable along a vertical support 14, which is itself vertically slidable along the guide 12'.

In each of the two shoulders 9 of the frame 8 there is a curved slot 15 in which there engage a pair of rollers 16 supporting a saddle 17, which supports the grinding device 4 and its drive motor 6. The radius of curvature of the slots 15 is such that when the rollers slide on them the abrasive sectors 5 of the grinding device 4 describe, in the region of contact with the rail 3 to be ground, a transverse curved surface having the same radius of curvature as the corresponding rail band to be ground.

A pair of geared motors of worm type, schematically shown with 18, are interposed between a longitudinal member 10 of the intermediate structure to the rail 3, in the manner described hereinafter.

A further geared motor 19 is interposed between the structure 1 and a longitudinal member 10 of the intermediate frame 8 to adjust, in the manner described hereinafter, the rest inclination of the grinding device 4 to the rail to be ground. Further geared motors 20, 20' are interposed between the structure 1 and the two tubular structures 11, 11', and a further geared motor 21 is interposed between the two portions 13 and 14 of the tubular structure 11'.

On the drawing the structure 1 is shown for a single rail 3, although in a practice it preferably extends from one rail to the other to form a single trolley slidable along the track. As gaps exist between the rails and the wheels of the grinding machine which could result in an inclination of the longitudinal axis of the machine to the track axis, with inevitable negative consequences for the grinding work, the invention in order to preserve perfect mutual parallelism provides two pairs of rollers 22, 23 by which the machine bears laterally against the rails. The roller 22 of each pair is rigid with the structure 1 and bears laterally against one rail 3; the other roller 23 is connected to the end of an arm 24 which is hinged to the structure 1 and is associated at its other end with a pneumatic cylinder-piston unit 25 which causes said roller 23 to adhere laterally to the other rail. In this manner the axis of the machine according to the invention always remains parallel to the track axis.

The operation of the machine according to the invention is as follows: having defined the extend of interference between the grinding device 4 and rail 3 to be ground by operating the geared motor 21 and hence by adjusting the portion of the support 11' relative to the vertical guide, and having also defined the amplitude of oscillation of the saddle 17 relative to the intermediate frame 8, the electric motor 6 and the geared motor 18 are powered. The electric motor 6 rotates the grinding device 4 to thus produce the grinding effect on the rail 3. The geared motors 18 cause the grinding device to undergo a series of transverse oscillations guided by its rollers 16 within the guide slots 15.

Because of the particular shape of said slots, the abrasive sectors 5 of the grinding device 4 on the one end restore the original curvature of the rail 3, eliminating in particular the internal longitudinal projection which it develops with use, and on the other hand wear uniformly to preserve their original profile, notwithstanding their wear.

The wear compensation takes place in accordance with the known principle, described in detail in EP-A2-O 318 521.

The aforesaid presupposes that the abrasive sectors 5 originally have a curved transverse profile conforming to the original profile of the rails 3. However, as the abrasive sectors usually obtainable commercially in practice have a straight transverse profile, the sectors must be initially shaped to conform to the transverse profile of the rail to be ground. This can be done either by operating the machine for a few meters along the rail portion to be ground so that the transverse oscillations of the grinding device give these sectors the desired transverse curvature, or by associating with the grinding device 4 a diamond-set tool 26 comprising a tip 27 oscillating transversely to describe a circular arc with a curvature corresponding to that to be formed in the abrasive sectors 5.

As stated, a railway rail 5 has a transverse profile comprising a central band with a radius of curvature of 300 mm connected to two lateral bands of 80 mm radius of curvature, these being connected to two outer bands of 13 mm radius of curvature. Thus whereas the grinding of the central band is done in the described manner, the grinding of the lateral bands requires the shoulders 9 to be previously replaced by others in which the slots 15 have the curvature corresponding to that of the lateral bands to be ground, and the replacement of abrasive sectors 5 by others of a like curvature.

Then operating the geared motors 19 the grinding device is inclined to the central plane of the lateral band to be ground, and as this inclination inevitably involves a lateral movement of the device, the geared motors 20, 20' are operated to cause the entire intermediate frame to slide along the transverse guides 12, 12' of the structure 1, to thus make the central plane of the band to be ground.

At this point the grinding operation is performed in the initially described manner.

Instead of operating with a single grinding device with interchangeable parts corresponding to the position and curvature of the rail bands to be ground, it is possible to operate with several devices in succession, each acting on a different longitudinal band of the rail. In this case it is no longer necessary either to adjust the lateral inclination of the grinding device or to adjust its lateral movement, however an oscillatory movement of each grinding device is still required about its neutral position, whether this is vertical or inclined. These transverse oscillations are always obtained by the geared motors 18.

It should be noted that there are five different-curvature bands on a railway rail, and it would therefore seem at first sight that five grinding devices would be required. However as the deformation of the rails 3 generally involves their inner part, only three grinding devices are required, one acting on the central band of 300 mm curvature, another on the inner lateral face of 80 mm curvature, and the third on the inner end face of curvature 13 mm.

From the aforegoing it is apparent that the tangential grinding machine according to the invention is particularly advantageous, in that:

- it enables the profiles of railway rail to be totally and perfectly ground, however deformed;
- it combines the merits of the tangential grinding wheel with those of the traditional cup grinding wheel while at the same time eliminating the drawbacks of this latter, i.e. the large number of tools and the resultant "flats" on the ground rail;
- using a single grinding wheel for every rail radius of curvature results in easy control of the work high productivity and substantially quiet operation;
- it maintains a constant abrasive sector profile and in fact restores it in a virtually perfect manner.

I claim:

1. A tangential grinding machine, particularly for railway rails, comprising a rotating member (4), for rotation about a transverse axis, a plurality of abrasive sectors (5) having curved transverse profiles conforming to the original profiles of the rails and mounted on supports radially movable on said rotating member, elements which radially move said supports in order to move said abrasive sectors outwards toward said rail by an extent which compensates their wear, and a plurality of sensors which when a predetermined degree of wear of the abrasive sectors is attained are activated to act under the control of an electronic unit on the radially movable supports, in order to restore the original grinding surface of the abrasive sectors which have undergone wear, characterised in that between the rotating member (4) provided with abrasive sectors (5) and the machine structure (1) slidable on the rail (3) there is interposed an articulated frame (8) having spaced-apart shoulders (9) joined by longitudinal members (10) for supporting said rotating member (4) with the transverse axis and provided with means (15, 16, 17) which cause said rotating member (4) with transverse axis to undergo transverse oscillations about a longitudinal axis substantially coinciding with the axis of curvature of the corresponding band of the rail (3) to be ground.

2. A tangential grinding machine as claimed in claim 1, characterised in that the intermediate frame (8) is hinged to the structure (1) about two coaxial longitudinal pins and is provided with an actuator (19) connected to said structure (1) to define the central position of the rotating member (4).

3. A tangential grinding machine as claimed in claim 1, characterised in that the structure (1) is provided with transverse guides (12, 12') for supports (11, 11') of the intermediate frame (8), the positioning of this latter along said guides being obtained by actuators (20, 20').

4. A tangential grinding machine as claimed in claim 3, characterised in that the intermediate frame (8) is hinged at one support (11) to a transverse guide (12) of the structure (1) and has its other support (11') vertically adjustable to adjust the interference between the rotating member (4) and the rail (3) to be ground.

5. A tangential grinding machine as claimed in claim 2, characterised in that the rotating member (4) is hinged to the intermediate frame (8) about a longitudinal axis coinciding with the axis of curvature of that band of the rail (3) to be ground.

6. A tangential grinding machine as claimed in claim 2, characterised in that the shoulders (9) have curved slots (15) with center curvature lying on the axis of curvature of that band of the rail (3) to be ground, in each slot there being engaged a pair of guide rollers (16) rigid with a saddle (17) supporting the rotating member (4), said saddle being connected to the intermediate frame (8) via at least one actuator (18), which impresses transverse oscillations on it during the rotation of the rotating member (4).

7. A tangential grinding machine as claimed in claim 1, characterised in that the intermediate frame (8) comprises two pairs of rollers (22, 23) for laterally bearing against the two rails (3) of the track in order to eliminate any clearance between the wheels (2) of said structure (1) and said rails.

8. A tangential grinding machine as claimed in claim 7, characterised in that each pair of rollers (22, 23) comprises a first roller (22) of vertical axis rigid with the structure (1) and adhering to the inner side of a rail (3) and a second roller (23) also of vertical axis, mounted at the end of an arm (24) hinged to the structure (1) and urged at its other end by an actuator (25) to press said roller (23) against the inner side of the other rail (3).

9. A tangential grinding machine as claimed in claim 1, characterised by comprising a diamond-set tool (26) consisting of a rod hinged to the intermediate frame (8) such that the tool tip (27) describe a transverse circular arc having a radius of curvature corresponding to the radius of curvature of that band of the rail (3) to be ground.

10. A tangential grinding machine as claimed in claim 1, characterized in that several rotating members (4) acting on different bands of the rail (3) to be ground are mounted on the structure (1), each rotating member oscillating transversely about a central position coinciding with the longitudinal central plane of the corresponding band.

11. A tangential grinding machine as claimed in claim 2, characterized in that several rotating members (4) acting on different bands of the rail (3) to be ground are mounted on the structure (1), each rotating member oscillating transversely about a central position coinciding with the longitudinal central plane of the corresponding band.

12. A tangential grinding machine as claimed in claim 3, characterized in that several rotating members (4) acting on different bands of the rail (3) to be ground are mounted on the structure (1), each rotating member oscillating transversely about a central position coinciding with the longitudinal central plane of the corresponding band.

13. A tangential grinding machine as claimed in claim 4, characterized in that several rotating members (4) acting on different bands of the rail (3) to be ground are mounted on the structure (1), each rotating member oscillating transversely about a central position coinciding with the longitudinal central plane of the corresponding band.

14. A tangential grinding machine as claimed in claim 5, characterized in that several rotating members (4) acting on different bands of the rail (3) to be ground are mounted on the structure (1), each rotating member oscillating transversely about a central position coinciding with the longitudinal central plane of the corresponding band.

15. A tangential grinding machine as claimed in claim 6, characterized in that several rotating members (4) acting on different bands of the rail (3) to be ground are mounted on the structure (1), each rotating member oscillating transversely about a central position coinciding with the longitudinal central plane of the corresponding band.

16. A tangential grinding machine as claimed in claim 7, characterized in that several rotating members (4) acting on different bands of the rail (3) to be ground are mounted on the structure (1), each rotating member oscillating transversely about a central position coinciding with the longitudinal central plane of the corresponding band.

17. A tangential grinding machine as claimed in claim 8, characterized in that several rotating members (4) acting on different bands of the rail (3) to be ground are mounted on the structure (1), each rotating member oscillating transversely about a central position coinciding with the longitudinal central plane of the corresponding band.

18. A tangential grinding machine as claimed in claim 9, characterized in that several rotating members (4) acting on different bands of the rail (3) to be ground are mounted on the structure (1), each rotating member oscillating transversely about a central position coinciding with the longitudinal central plane of the corresponding band.

* * * * *